US006389850B1

(12) United States Patent
Fujiwara

(10) Patent No.: US 6,389,850 B1
(45) Date of Patent: May 21, 2002

(54) FABRIC AND METHOD FOR OBTAINING GARMENT THEREFROM AND GARMENT

(75) Inventor: Toshio Fujiwara, Tokyo (JP)

(73) Assignee: Kabushiki Kaisha Miyake Design Jimusho, Tokyo (JP)

( * ) Notice: Subject to any disclaimer, the term of this patent is extended or adjusted under 35 U.S.C. 154(b) by 0 days.

(21) Appl. No.: 09/616,439

(22) Filed: Jul. 14, 2000

(30) Foreign Application Priority Data

Oct. 4, 1999 (JP) ..... 11-282878

(51) Int. Cl.[7] ..... D04B 7/30
(52) U.S. Cl. ..... 66/176; 66/171
(58) Field of Search ..... 66/8, 17, 169 R, 66/170, 171, 172 R, 175, 176, 179, 196, 195, 192; 139/383 R, 384 R, 387 R, 390, 397, 409

(56) References Cited

U.S. PATENT DOCUMENTS 3,985,003 A * 10/1976 Reed ..... 66/196
4,095,441 A * 6/1978 Robinson et al. ..... 66/176
4,682,479 A * 7/1987 Pernick ..... 66/176
5,081,854 A * 1/1992 Lonati ..... 66/176
5,651,847 A * 7/1997 Loeffler ..... 156/71

FOREIGN PATENT DOCUMENTS

| | | |
|---|---|---|
| JP | S52-12306 | 4/1977 |
| JP | S54-11053 | 5/1979 |
| JP | S62-153304 | 9/1987 |
| JP | H5-51836 | 2/1993 |

* cited by examiner

*Primary Examiner*—Danny Worrell
(74) *Attorney, Agent, or Firm*—Pitney, Hardin, Kipp & Szuch LLP

(57) ABSTRACT

A fabric for cutting therefrom a garment having a first layer for a front body of the garment and a second layer for a back body of the garment, which layers are basically separated from each other. The first and second layers are knitted or woven or stitched along an outer profile 14 of a garment, which is unfinished or semi-finished at locations such as neck hole and sleeve where portions of a wearer are passed. A cutting of the fabric is done along the outline in such a manner that the unfinished or semi-finished garment is separated from the fabric. A cutting of the neck hole is done in such a manner that the size of the neck hole 40A, 40B or 40C is matched to a particular wearer's size and his or her preference.

6 Claims, 9 Drawing Sheets

FABRIC AND METHOD FOR OBTAINING GARMENT THEREFROM AND GARMENT

BACKGROUND OF THE INVENTION

1. Field of the Invention

The present invention relates to a continuous length of fabric from which garments are directly obtained.

2. Description of Related Art

A process for obtaining a garment which has been, for a long time, practiced is such that a fabric, such as woven or knitted fabric is subjected to a cutting process using respective pattern papers, by which parts of garment, such as a front body, a back body and a collar are obtained, and, then, a sewing is executed, by which these parts are connected with each other, thereby obtaining a garment.

In order to obtain an increased production efficiency, a computerized system has recently developed as far as the cutting is concerned, in which system a data base is provided for storing pattern papers of various sizes, a selection of a pattern matched to a size measurement is, then, done from the stored pattern, thereafter, the selected pattern paper is corrected in accordance with the result of the measurement, and, finally the cutting of the fabric along the corrected pattern is done by using a cutting equipment such as a laser cutter, thereby obtaining separated parts of the garment, such as a front and back bodies and a collar.

As far as a sewing process is concerned, an automation is, however, very difficult. Therefore, the sewing is still now basically done under a manually operated basis, which construct a bottleneck not only from a view point of an increase in a production efficiency but also from the view point of a decrease in a production cost. In other words, the existence of a sewing process has been a great problem in processes for producing a garment. Thus, there has been a long felt demand in a production of a garment for eliminating or at least reducing the above problem in the sewing process.

Furthermore, apart from the matter of the above mentioned problem related to the sewing process, there are also drawback related to a conventional way of a production of ready-made garments. Namely, ready-made garments are usually introduced into a market with some size variations. However, it is quite usual that there is a great limit in a number of size variations of ready-made garments, which makes it difficult that a garment is best matched to a particular user, since it is usual that the size of the particular user may frequently delicately different from the standard size and it is quite natural that a user has a particular preference. In view of this, it is quite usual that a selection of a ready-made garment is done at some degree of compromise, i.e., the selected garment is insufficient from the view point of the best fit, which makes the user to feel a certain kind of dissatisfaction.

In view of the above, the present invention aims to provide a garment without substantial necessity of sewing. The present invention also aims to make a garment to be a best fitted condition to a particular user regardless of a delicate difference of a size of the particular user from an available standard size.

SUMMARY OF THE INVENTION

According to the present invention, a continuous length of fabric for cutting therefrom a garment is provided, comprising a plurality of layers, at least one of which is a first layer as one side of a garment, while the remaining at least one of said layers is a second layer as the other side of a garment, the first and second layers being, basically, separated from each other, and connecting parts which integrally connect first and second layers with each other along an outer profile of a garment, which is unfinished or semi-finished except at locations where openings for passage of portions of a wearer are to be formed, said connecting parts along the outlines of the unfinished or semi-finished garments being, as repeated patterns, distributed at least along the length of the fabric.

According to the first embodiment of the present invention, said fabric is warp knitted fabric knitted by a warp knitting machine having at least two ground guide bars and at least two jacquard guide bars, wherein said first and second layers are knitted by using said respective ground guide bars, and wherein the connected parts are constructed by stitching the first and second layer by using the jacquard guide bars.

According to the second embodiment of the present invention, said fabric is a circular knitted fabric knitted by a circular knitting machine having dial needles and cylinder needles, wherein said first layer is knitted by solely using the dial needles, while said second layer is knitted by solely using the cylinder needles, and wherein the connected parts are constructed by a stitching using both of the dial needles and the cylinder needles.

According to the third embodiment of the present invention, said fabric is a woven multi layer fabric woven by a weaving machine provided with a jacquard mechanism, wherein at least one layer of the woven fabric constructs the first layer, while at least one remaining layer constructs the second layer, and wherein the connected parts are constructed by stitching the first and second layers with each other.

According to the second aspect of the present invention, a continuous length of fabric for cutting therefrom a fabric is provided, comprising a plurality of layers, at least one of which is a first layer as one side of a garment, while the remaining at least one of said layers is a second layer as the other side of a garment, the first and second layers being, basically, separated from each other, and connecting parts which integrally connect first and second layers with each other along an outer profile of a garment, which is adjustable at locations where openings for passage of portions of a wearer are to be formed, said connecting parts along the outlines of the unfinished or semi-finished garments being, as repeated patterns, distributed at least along the length of the fabric.

According to further aspect of the present invention, a method for producing a garment is provided, comprising the steps of:

forming a fabric having a plurality of layers, at least one of which becomes a first layer as one side of the garment, while the remaining at least one of said layers becomes a second layer as the other side of the garment, the first and second layers being, basically, separated from each other;

stitching integrally first and second layers with each other along an outline of a garment, which is unfinished or semi-finished except at locations where openings for passage of portions of a wearer are to be formed, and;

cutting the fabric along the outer profile while the stitched parts are at least partially left, thereby separating the garment from the fabric, while the cutting is such that the separated garment is matched to a wearer.

According to still further aspect of the present invention, an unfinished or semi-finished garment is provided, which is to be separated from a woven or knitted fabric and has a first layer and second layer and connecting parts as woven or knitted portions along an outline of the garment in such a manner that the first and second layers are integrated along the outline of the garment, the garment being unfinished or semi-finished at regions of the garment where openings for passage of portions of a wearer such as neck hole are to be formed.

BRIEF EXPLANATION OF ATTACHED DRAWINGS

Figure 1:
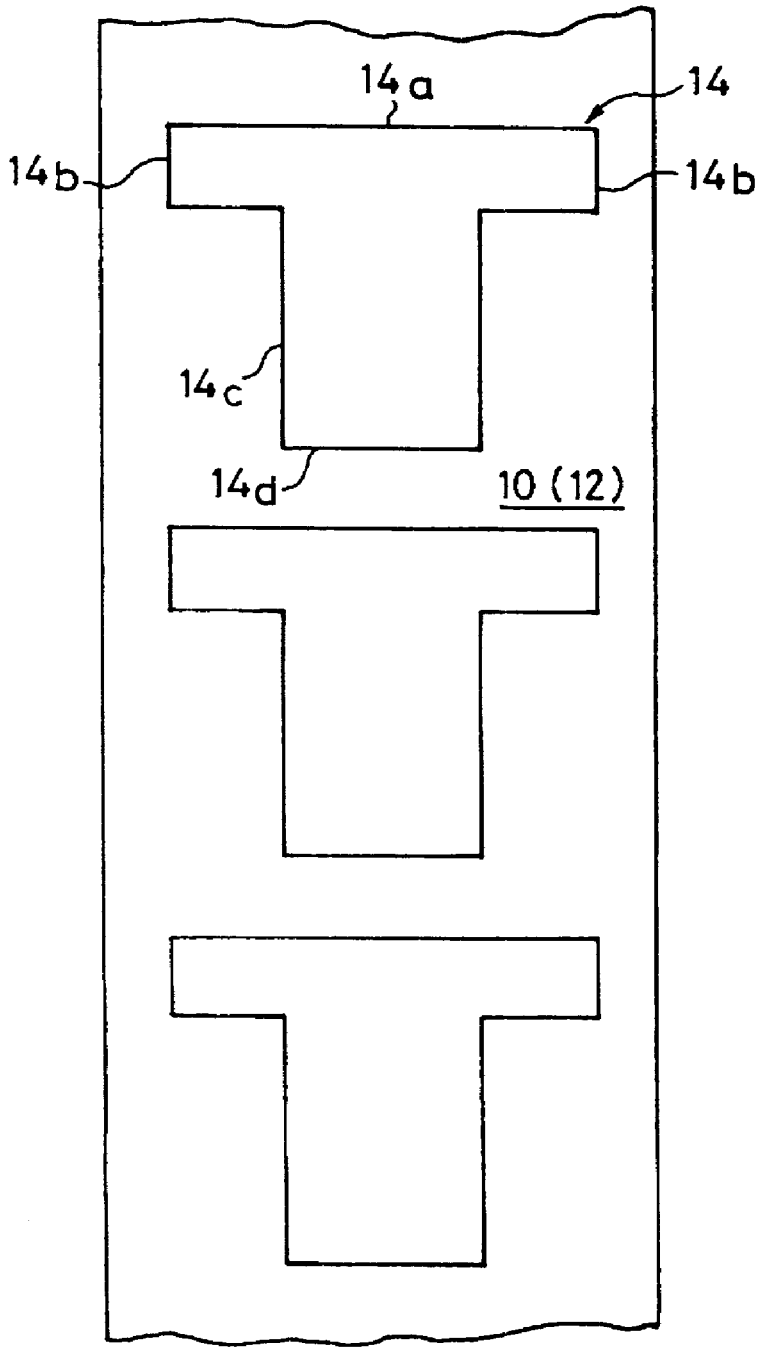
FIG. 1 is a schematic plan view of a continuous length of fabric according to the present invention.
Figure 4A:
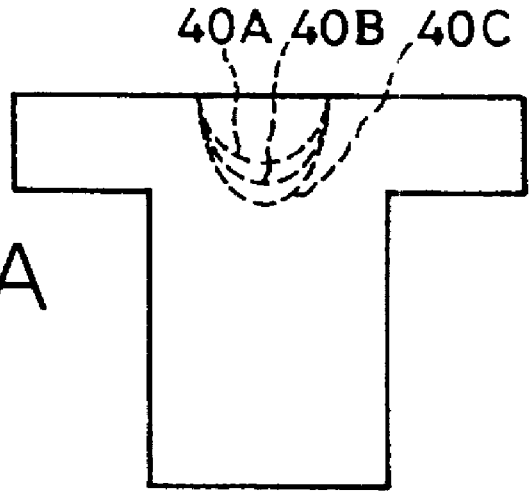
Figure 4B:
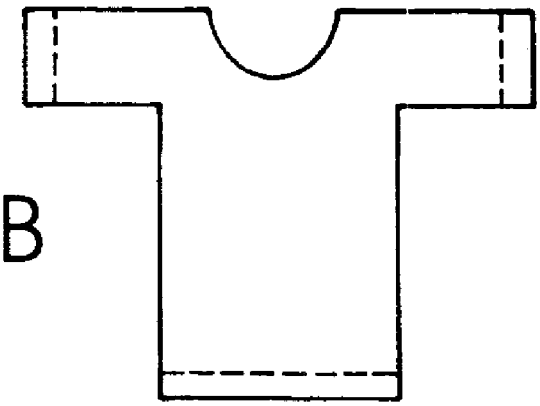
Figure 4C:
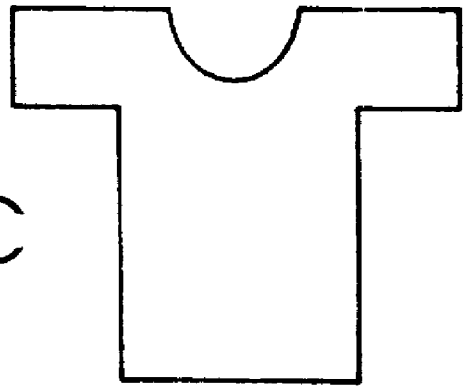

FIGS. 4A to 4*c* illustrate processes for obtaining a garment from the fabric in FIG. 1.

Figure 5A:
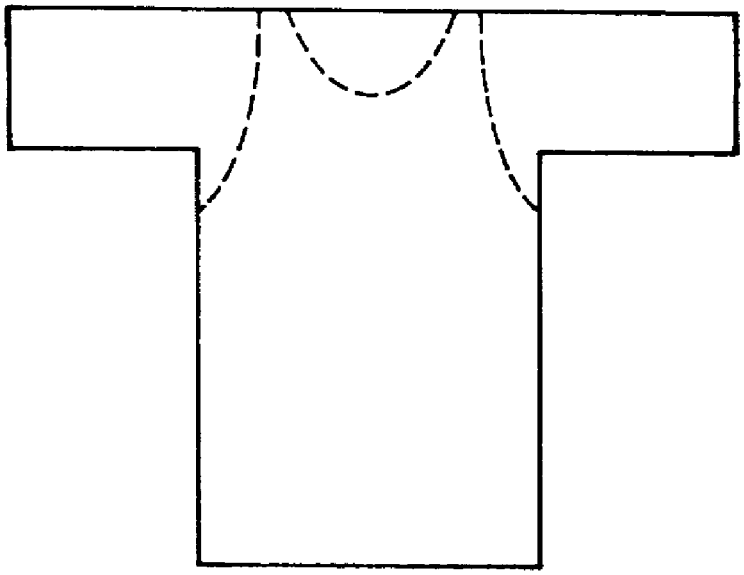
Figure 5B:
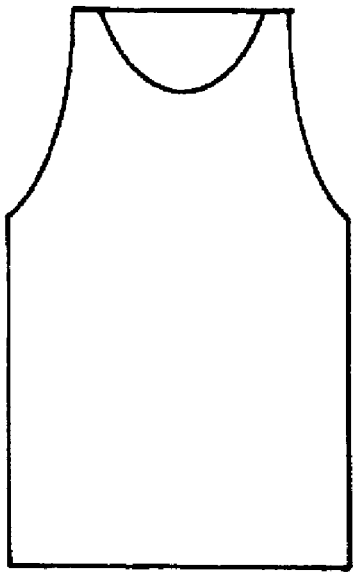

FIGS. 5A and 5B illustrate processes for obtaining a garment of different shape from the fabric in FIG. 1.

Figure 6:
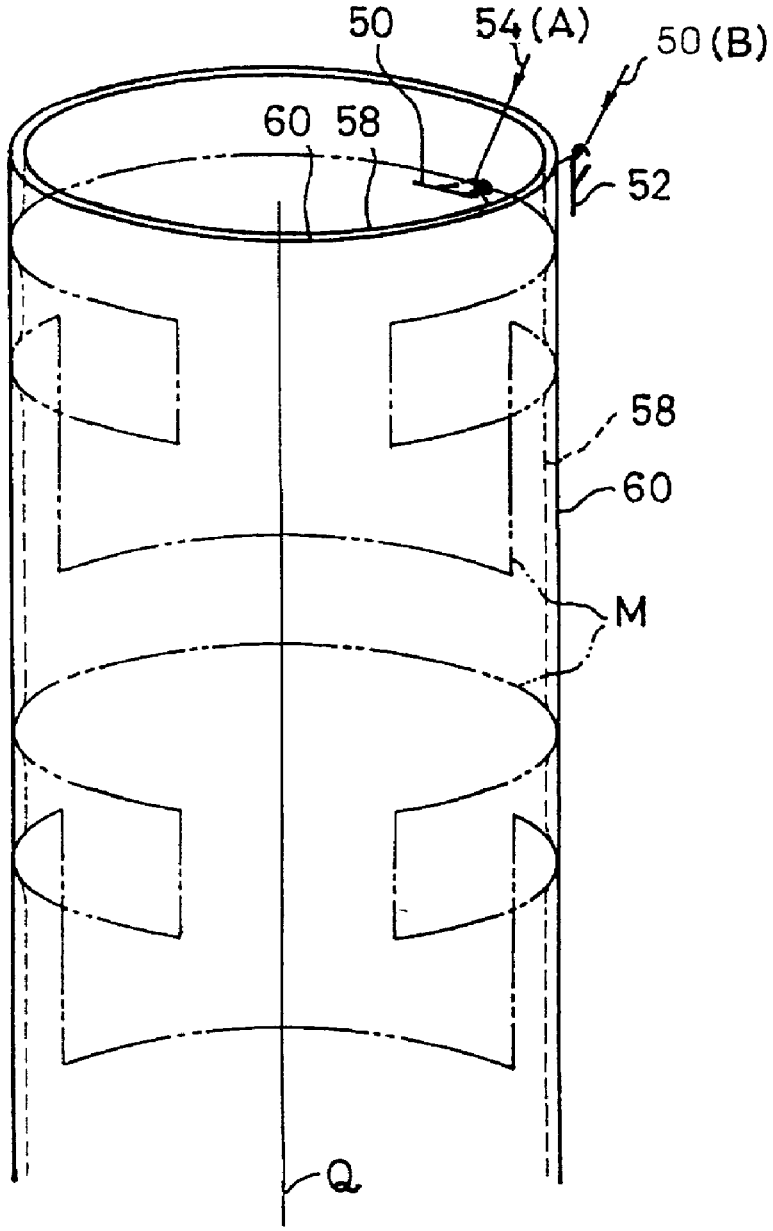

FIG. 6 is a schematic perspective view of an inner and outer tubular fabrics as well as stitching construction in the execution of the present invention by a circular knitting machine.

Figure 7:
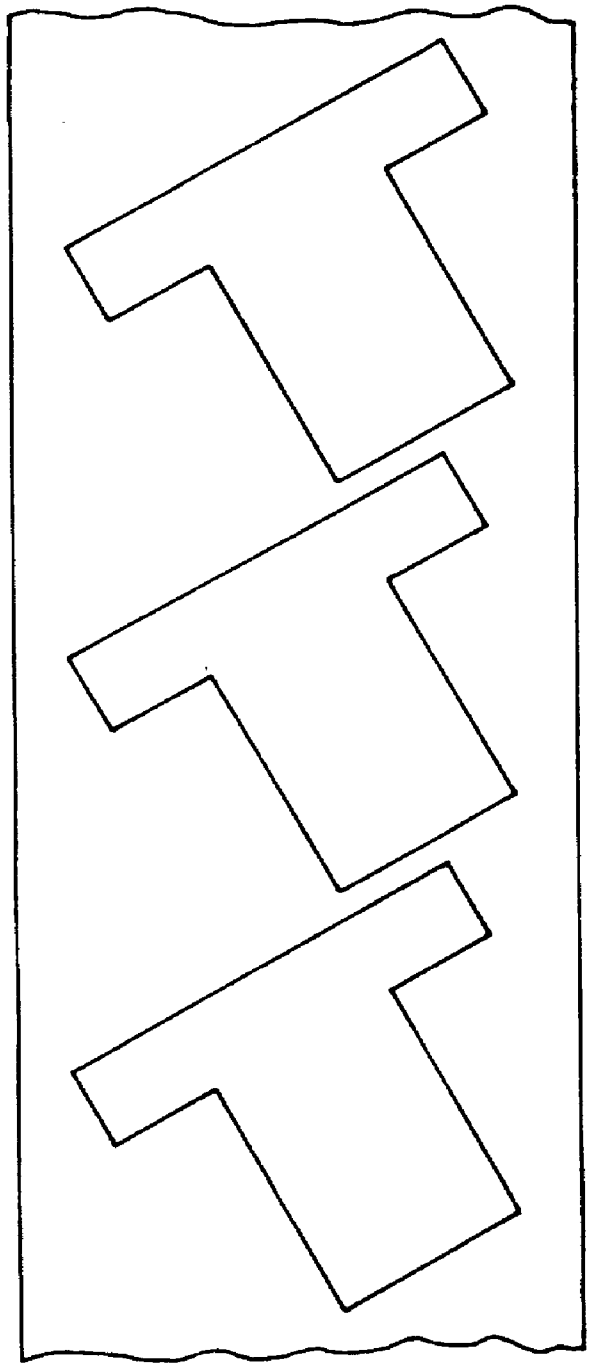

FIG. 7 shows a desired arrangement of patterns on a fabric in the execution of the present invention in a circular knitting.

Figure 8:
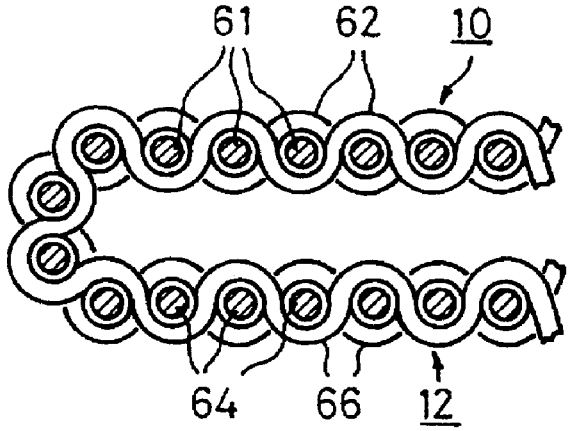

FIG. 8 is a cross sectional view of a fabric at selvage portion in the execution of the present invention in a woven fabric.

Figure 9:
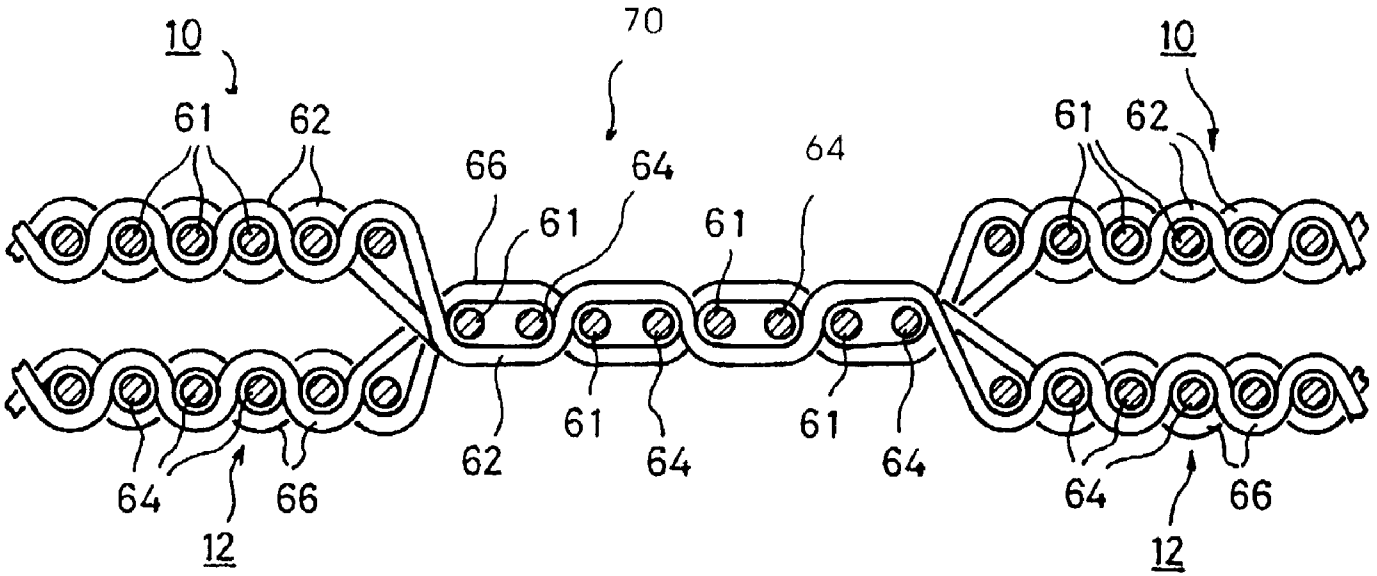

FIG. 9 is similar to FIG. 8 but illustrates a cross sectional view of a fabric at a location along a cutting line.

Figure 10:
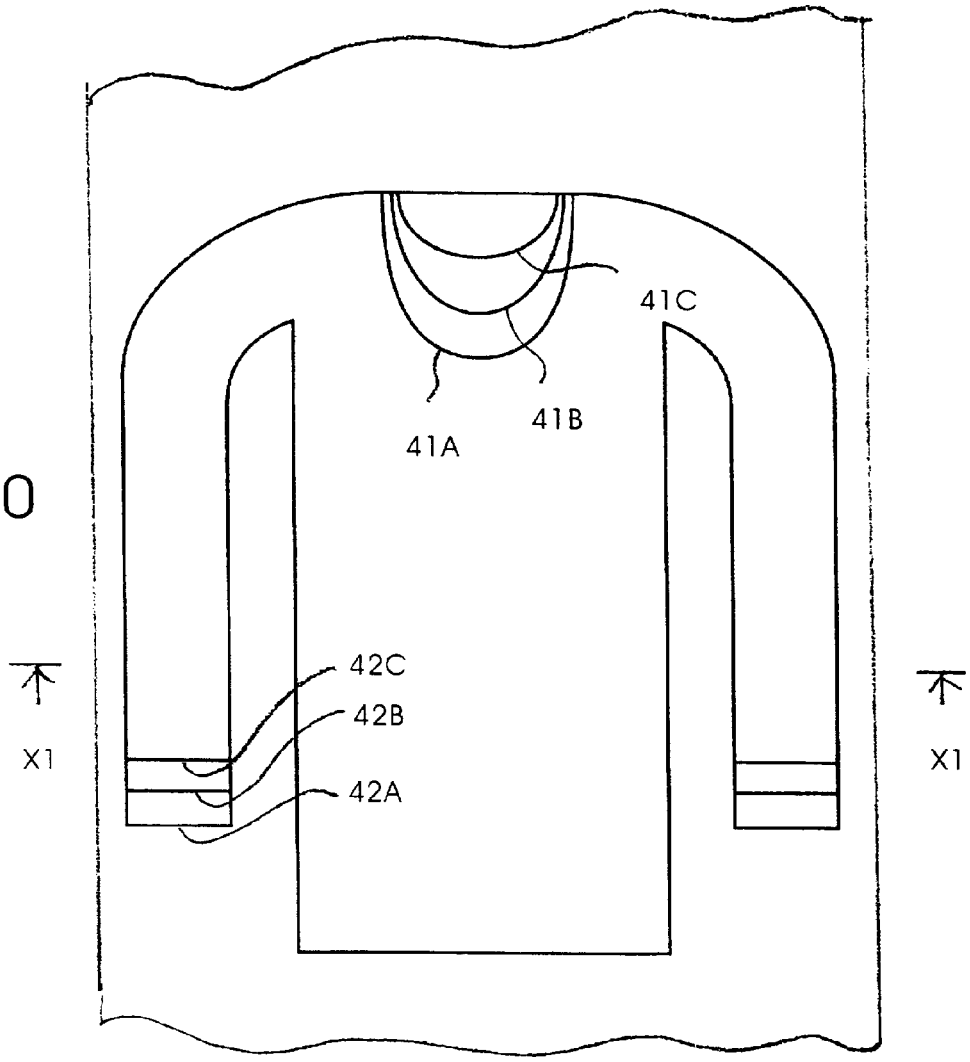
Figure 11:
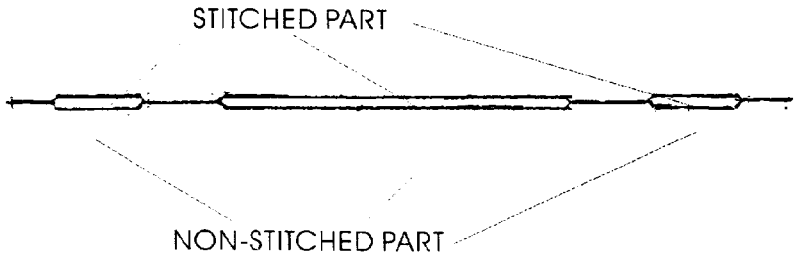

FIG. 10 illustrate, in a further embodiment, a fabric in which a semi-finished garment with adjustable size at neck as well as sleeve portions is incorporated.

DESCRIPTION OF PREFERRED EMBODIMENTS

Figure 2:
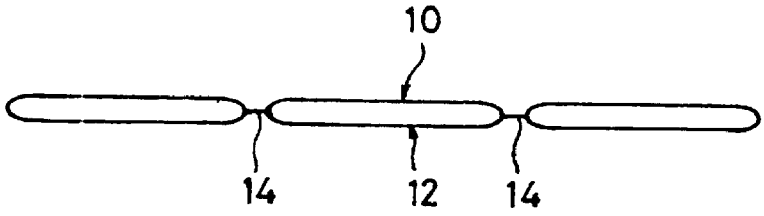
FIG. 2 is a schematic cross sectional view of the fabric according to the present invention.

FIGS. 1 and 2 show very schematically a fabric of a hose shape according to a practice of the present invention. Namely, the fabric is provided with a first or outer layer 10 and a second or inner layer 12, which are basically separate with each other. After the cutting of the fabric to garments, the first layer 10 functions as a first side, for example, a front body of the garment, while the second layer 12 functions as a second, for example, a back body of the garment.

In FIG. 14, a reference numeral 14 denotes a stitching line for connecting the first and the second layers 10 and 12 with each other. The stitching line 14 is formed as an outline of a garment when it is under a flattened condition. Namely, the line includes a portion 14*a* from a neck to a shoulder, sleeve portions 14*b*, side portions 14*c* and a base portion or hemline 14*d*. According to the present invention, among these portions along the outline of the garment, the portions 14*a*, 14*b* and 14*d*, whereat openings for passage of wearer's body portions, such as the neck, the sleeve and the hemline, are under unfinished or semi-finished condition. Namely, at the neck portion 14*a*, the sleeve portion 15*b* and the base portion 14*d*, the first and the second layers 10 and 12 are integrated or stitched with each other. Namely, according to the essential feature of the present invention, to the unfinished or semi-finished portions of the garments such as the neck portions and the sleeve portions, a cutting is done in such a manner that a desired size or shape or a length, which is matched to a customer's particular requirements, such as a customer's size and preference, is obtained. Such a cutting is done at a shop or retailer and such cut garments are commodities which are to be sold to the customers.

As shown in FIG. 1, the stitching line 14 as the outline of the garment is repeated patterns on the fabric in the length thereof. The repeated patters may, also, extend not only in the longitudinal direction as shown in FIG. 1 but also in the transverse direction. According to the present invention, these fabric is brought to a shop or retailer, whereat a cutting of the fabric is done to obtain garments, which are sold to customers. As an alternative, the semi-finished or non-finished garments according to the present invention can be fed to a shop or retailer. On the other hands, a usual type of a selling of ready made garments is such that garments are, from a supplier, such as a wholesaler, under completely finished condition, supplied to a shop. The garments are arranged in the shop, while, as far as size is concerned, a customer selects a size which is matched to him from available variations in size such as L (large), M (medium) and S (Small). However, a range of selection of size is not so wide, so that the selected one is not completely matched with the particular customer. On the other hands, a freedom is not so wide as far as a size adjustment is concerned. Thus, only a limited size adjustment, such as adjustment of the length of a pants is possible. Contrary to this, according to the present invention, a freedom can be highly increased as far as the size or shape adjustment is concerned. Namely, according to the present invention, formed on the fabric are stitched lines between the upper and lower layers as outlines of garments as repeated patterns. Furthermore, according to the present invention, a garment as the upper and lower layers stitched along the outline is unfinished or semi-finished as far as portions of the garment for the passage of human body such as a neck, a sleeve and a hemline are concerned. Furthermore, at a shop, a size measurement is done for a customer and his preference is investigated. Based on the factors such as the size measurement and the customer's preference, a cutting of the fabric is done in such a manner that desired values are obtained as far as factors such as a neck size, a sleeve length and a body length are concerned. Furthermore, if necessary, a dyeing is done by using a small sized dyeing machine. As a result, the idea of the present invention makes it possible to obtain a completely finished garment adjusted under the customer to customer basis.

Figure 3:
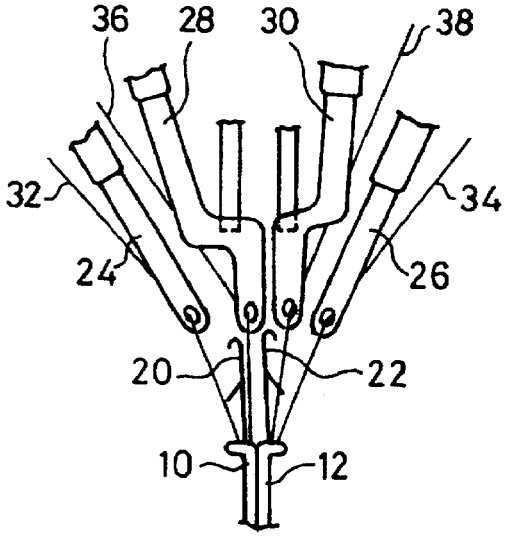
FIG. 3 is a schematic view of a weft knitting machine for obtaining the fabric in the first embodiment of the present invention.

In the first embodiment, the fabric is obtained by using a raschel warp knitting machine having at least two ground guide bars and at least two jacquard guide bars. Namely, FIG. 3 illustrates schematically raschel warp knitting machine, which includes two arrays (beds) of needles 20 and 22, two arrays of ground guide bars (beds) 24 and 26 arranged to be faced with the needle arrays 20 and 22, respectively and two arrays of jacquard guide bars 28 and 30. The ground guide bars 24 have eyelets through which warp yarns 32 are passed. As a result of well known knitting motion of the needles 20 together with the guiding movement of the guide bars 24, the first layer 10 of weft knitted fabric is created. Similarly, the ground guide bars 26 have eyelets through which warp yarns 34 are passed. In the similar way, the second layer 12 of weft knitted fabric is created. The first and second layers 10 and 12 are at non-stitched parts separate from each other. Furthermore, the jacquard guide bars 28 and 30 have eyelets, through which warp yarns 36 and 38 are respectively passed. The movement of the jacquard guide bars 28 and 30 are such that the first and second layers 10 and 12 are, along the contour line 14, stitched by means of the warp yarns 36 and 38. As a result, the construction of the according to the invention is created, wherein the first and second layers 10 and 12, which are basically separated from each other, are stitched by the warp yarns 36 and 38.

It should be noted that stitching of two basically separate layer along a contour line of a garment by using a warp knitting machine as shown in FIG. 3 is, itself, disclosed in JII (Japanese Institute of Invention and Innovation) Journal of Technical Disclosure (Kogi) No. 86-5822. In this prior art, a garment is also cut out from the warp knitted fabric by cutting along the contour line. The present invention as explained with reference to FIG. 1 features that garments integrated on the warp knitted fabric is unfinished or semi-finished and the cutting is done in such a manner that a finished product adjusted to a customer is produced.

Now, a method for forming a garment from the length of the warp knitted fabric according to the present invention will be explained. Brought into shop is the length of the fabric as shown in FIG. 1 or unfinished or semi-finished garments which are, along the outline, cut out from the fabric. As an alternative, the cut out unfinished or semi-finished garments are brought into shop. At the shop, size measurement is done for a particular customer, which, together with his preference as known, allows a cutting to be suitably done for this particular customer at the neck or collar. FIG. 4A illustrates an example of cut line as shown by 40A, 40B or 40C at the neck portion. The cutting can be done manually by using a scissors. These cut line may not necessarily be prefixed. In other words, the cut line is a free one, which is matched to the result of the size measurement or the preference of the particular customer. When compared with the conventional way of selection, wherein a customer can only select one of matched size from the existing variations in size, such as L (large), M (medium) and S (small), a degree of freedom of the size adjustment can be limitlessly increased. FIG. 4B illustrates a garment after the execution of cutting at the neck portion. Furthermore, in FIG. 4B, free cut line at the sleeves and the hemline are shown by dotted line, which are similarly determined as a result of the size measurement as well as the preference of a customer. In other words, at the sleeve or the hemline, a limitless freedom as to the selection of the cut line can be obtained. FIG. 4C shows a finished garment after the execution of the cutting at the neck, sleeve and hemline. The finished garment is handed to the particular customer.

If it is necessary, a small sized dyeing machine is provided at a shop. If it is necessary, a customer can receive a service where the garment is subjected to an after-dyeing process, by which a design of desired colors selected by the customer can be imparted the garment.

As in the case in the first embodiment of the present invention, the fabric is a warp knitted one, which is advantageous in practicing the present invention, since the warp knit fabric is, as well known to those skilled in this art, provided with a particular entangled structure between warp yarns, which prevents the close from being loosened at the cut line without any additional sewing process.

FIGS. 4A to 4C are for an illustration of a cutting of a so-called T-shirt as a garment from the fabric in FIG. 1 according to the present invention. However, the idea of the present invention makes it possible to obtain a garment of a different shape. FIGS. 5A and 5B illustrate a formation of a garment of a so-called tank top shape by cutting the fabric in FIG. 1 on which unfinished or semi finished garments are formed. Namely, in FIG. 5A, a dotted line illustrates a cut line around the neck and sleeve portions on the fabric in FIG. 1. As a result, after the completion of the cutting process, a garment of the so-called tank top shape can be obtained as shown in FIG. 5B. In this case, a cut line can be desirably selected in such a manner a garment is obtained, which is best matched not only to a customer's size but also to his preference.

In a modification of the present invention, a plurality of cut lines may be formed in a fabric integrated in a garment. Namely, in FIG. 10, repetition of stitched lines (patterns) along closed outlines are formed on a hose shaped fabric. The fabric is provided with a top layer functioning as a front body of the garment and a back body of the garment, which are stitched along the closed outline. At a neck portion of the garment, a plurality of cut lines 41A, 41B and 41C are formed. At a sleeve portion of the garment, a plurality of cut lines 42A, 42B and 42C are formed. At the cut lines 41A, 41B and 41C and 42A, 42B and 42C, the way of stitching may be different from that of the remaining parts of the garment on the fabric, which makes a customer to easily notice that the lines 41A, 41B and 41C and 42A, 42B and 42C are for cutting. In this case, the freedom of the size adjustment is limited to a number of cut lines.

The idea of the present invention may also realized in a circular knitted fabric. In this case, the knitting of a fabric is done by a circular knitting machine having a series of dial needles and a series of cylinder needles. The fabric is constructed by a first or inner tubular layer knitted solely by the dial needles, a second or outer tubular layer knitted solely by the cylinder needles and stitched part along an outline of a garment which is knitted by using both of the dial and cylinder needles. FIG. 6 schematically illustrates a circular knitting machine having a series of circumferentially spaced dial needles 50 (only one of which is shown) and a series of circumferentially spaced cylinder needles 52 (only one of which is shown). Arranged along the circumference of the knitting machine are a plurality of yarn feeders of, for example, number of 48, which are grouped into a first group A. The yarns fed from the feeders in the group A are illustrated reference number 54 (only one of which is shown in FIG. 6). The yarns fed from the feeders in the group B are illustrated reference number 56 (only one of which is shown in FIG. 6). Furthermore, except for the stitching parts, at the yarn feeders in the group A, only the dial needles 50 participate in knitting operation, i.e., the needle selection mechanism at the yarn feeder of group A operate in such a manner that no cooperation of the cylinder needles 52 with a lifting cam does not occur, while at the yarn feeders in the group D, only the cylinder needles 52 participate in knitting operation, i.e., the needle selection mechanism at the yarn feeder of group B operate in such a manner that no cooperation of the dial needles 50 with a lifting cam does not occur. As a result, a progress in the knitting process causes a double tube structure to be obtained, which is constructed by an inner tubular layer 58 knitted by the yarns 54 and by an outer tubular layer 60 knitted by the yarns 56.

In short, the tubular inner layer and tubular outer layer 60 in this embodiment are, basically, knitted solely by the dial needles 50 and the cylinder needles, respectively, and, therefore, these layers 58 and 60 are basically separate from each other. Since the layers 58 and 60 are knitted by solely using the dial and cylinder needles 50 and 52, respectively, the layers 58 and 60 are basically plain stitch, which is, if desired, combined with its modified stitch such as a tuck stitch or a welt stitch.

In FIG. 6, a phantom line M illustrates, schematically, a closed outline of a garment having a front body as one of the inner and outer layers 58 and 60 and a back body as the other of the inner and outer layers. At the area of the fabric along the closed line M, the inner and the outer tubular layers 58 and 60 are integrated as one layer. In other words, when the area of a predetermined width along the outline M of the garment, the knitting of the yarns 54 at the yarn feeders of the group A is practiced not only by the dial needles 50 but also by the cylinder needles 52 and the knitting of the yarns 56 at the yarn feeders of the group B is practiced not only by the cylinder needles 52 but also by the dial needles 50. The type of stitch at the integrated part along the outline M of the garment can, for example, be bird's eye stitch.

The outline M is a pattern which extends along the entire width of the fabric. It is a common practice in this field that knitting of such a large patterned fabric is done by using a circular knitting machine having electronic pattern making mechanism for each of the dial and cylinder needles, such as double knitting type circular knitting machine. In knitting process using such a type of the circular knitting machine, a digitizing of the pattern is, first, done to obtain a digital data of the pattern which is input into a computer. Based on the data corresponding to the pattern (outline of the garment), the computer issues signals for operating actuators for controlling the needle selection operation, i.e., the selective engagement of the needles with a needle lifting cam, under a needle to needle basis. In more detail, at the knitting operation for the area other than that along the garment outline M, the control signals to the needle selection actuators are such that, at the location other than the outline M, the inner layer 68 is knitted solely by the dial needles 50 while the outer layer 60 is knitted by the cylinder needles 52 and, at the location along the outline M, knitting is done by both of the dial and cylinder needles 50 and 52.

As a result of the progress of knitting operation, a double layered circular knitted fabric is obtained, wherein the stitching lines M which connect the inner and outer layers are repeated along the length of the fabric. After completion of the knitting process, the fabric is subjected to cutting along a longitudinal line Q, so that a continuous length of fabric is obtained, which is, as similar to FIG. 1, provided with repeated outlines (patterns) of unfinished or semi-finished garments. Then, in similar way as explained with reference to the first embodiment, cutting of the fabric along the outlines of the unfinished or semi-finished garments is done in accordance with the result of the size measurement and/or preference of a particular customer, which allows a garment to be obtained, which is the best fitted to the requirement of the customer.

As well known to those skilled in this art, a cutting of a circular knitted fabric causes a loosening to be likely in case where the cutting line runs along the direction parallel to the direction of a course. In order to combat this problem, an inclined arrangement of the outlines of garments as repeated pattern on the fabric as shown in FIG. 7 is desirable. Namely, such an arrangement allows that the cutting line runs, as less as possible, in the direction parallel to the course direction, which causes a loosening to be less likely.

Furthermore, the idea of the present invention is realized in case where a fabric is the one which is woven. In this case, the fabric is constructed as a multiple weave structure. In this case, the multi weave fabric is provided with a first layer 10 (FIG. 2) and a second layer 12, which are stitched with each other along outlines of garments as repeated patterns. Namely, as a modification shown in FIG. 8, the fabric is, basically, double fabric. The upper or first woven layer 10 is constructed by warp yarns 61 and weft yarns 62, while the lower or second woven layer 12 is constructed by warp yarns 64 and weft yarns 66. In this specific embodiment, the double fabric is constructed as so-called a hose weave, in which the upper and lower weft yarns are integrated in such a manner that the upper weft yarns 62 are, at the region of selvage, transferred into the lower weft yarns 66. However, the idea of the present invention can be applied to a double weave fabric having an upper and a lower layers which are, at the selvage, separated from each other.

According to this embodiment, where the fabric is constructed a double weave structure, the upper layer 10 of the double woven fabric becomes a front body of a garment, while the lower layer 12 of the double woven fabric becomes a back body of the garment. Furthermore, in the similar way as explained with reference to FIG. 1, stitching lines along the closed contours of unfinished or semi-finished garments are provided for connecting the first layer 10 as a front body of a garment and the second layer 12 of the garment.

FIG. 9 illustrates a weave structure at the stitching line along the closed contour of garments in this modification where the fabric is constructed as a double woven fabric. Namely, in this modification, the stitching line is constructed as a Oxford weave. Such an Oxford weave is, from the view point of a kind of weave construction, a single weave, wherein collected warp yarns as well as collected weft yarns are subjected to a weaving process under a plain weave structure. FIG. 9 shows a stitching line 70 extending, as similar to the line 14 in FIG. 1 in the first modification, along the closed outline of a garment, the warp yarns 61 and 64 are collected, while the weft yarns 62 and 66 collected, so that a integrated fabric is obtaind. In other words, along the stitching line 70, the upper layer 10 functioning as one of front and back bodies of a garment and the lower layer 12 functioning as the other of the front and back bodies of the garment are integrated. Such stitching lines as a closed outline of a garment extend, as repeated patterns, along the length of the fabric in the similar way as explained with reference to FIG. 1 in the first embodiment. The size of the stitching line 14 as a pattern is determined by the number of warp yarns, each of which can be subjected to independent shedding movement. In order to obtain a size of the repeated patter, i.e., the size of the garment extending along the substantial width of the woven fabric, a jacquard mechanism of a number of hooks as many as 5,000 is desirable.

In short, the third embodiment makes it possible to obtain a fabric having an upper and a lower layers which are separated from each other except as locations along a closed outline of an unfinished or semi-finished garment. In the similar way as explained with reference to FIGS. 4A and 4B, what is done in order to obtain a garment from the fabric is a desired cutting of the fabric along the closed counter in accordance with the result of a size measurement and/or the preference of a customer. Thus, the garment as cut out can be just fit to the customer's requirement.

In FIG. 1, the closed outline of a fabric as a pattern to be repeated is shown in such a manner that the outline extends in a direction parallel to the warp or weft direction. However, a more usual arrangement of the outline on the garment will be such that the stitching line extends, mainly, in any direction which is not parallel to warp direction nor to weft direction. However, the use of the jacquard mechanism makes it possible to obtain such a large sized pattern that extends along the entire width of the fabric.

What is claimed is:

1. A continuous length of fabric for cutting therefrom a garment, comprising a plurality of layers, at least one of which is a first layer as one side of a garment, while the remaining at least one of said layers is a second layer as the other side of a garment, the first and second layers being, basically, separated from each other, and connecting parts which integrally connect first and second layers with each other along an outer profile of a garment, which is unfinished or semi-finished at locations where openings for passage of portions of a wearer are to be formed, including a neck hole portion as blinded, said connecting parts along the outlines of the unfinished or semi-finished garments being, as repeated patterns, distributed at least along the length of the fabric.

2. A fabric according to claim 1, wherein said fabric is warp knitted fabric knitted by a warp knitting machine having at least two ground guide bars and at least two jacquard guide bars, wherein said first and second layers are knitted by using said respective ground guide bars, and wherein the connected parts are constructed by stitching the first and second layer by using the jacquard guide bars.

3. A fabric according to claim 1, wherein said fabric is a circular knitted fabric knitted by a circular knitting machine having dial needles and cylinder needles, wherein said first layer is knitted by solely using the dial needles, while said second layer is knitted by solely using the cylinder needles, and wherein the connected parts are constructed by a stitching structure using both of the dial needles and the cylinder needles.

4. A fabric according to claim 1, wherein said fabric is a woven multi layer fabric woven by a weaving machine provided with a jacquard mechanism, wherein at least one layer of the woven fabric constructs the first layer, while at least one remaining layer constructs the second layer, and wherein the connected parts are constructed by stitching the first and second layers with each other.

5. A method for producing a garment comprising the steps of:

forming a fabric having a plurality of layers, at least one of which becomes a first layer as one side of the garment, while the remaining at least one of said layers becomes a second layer as the other side of the garment, the first and second layers being, basically, separated from each other;

stitching integrally first and second layers with each other along an outer profile of a garment, which is unfinished or semi-finished except at locations where openings for passage of portions of a wearer are to be formed, including a neck location as blinded, and;

cutting the fabric along the outer profile while the stitched parts are at least partially left, thereby separating the garment from the fabric, while the cutting is such that the separated garment is matched to a wearer at said where openings for passage of portions of a wearer are to be formed, such that a sleeve length as well as body length are matched to the wearer's size and such that at the neck portion a neck hole is created so as to be matched to the wearer's size.

6. An unfinished or semi-finished garment to be separated from a woven or knitted fabric and having a first layer and second layer and connecting parts as woven or knitted structure along an outline of the garment in such a manner that the first and second layers are integrated along the outline of the garment, the garment being unfinished or semi-finished at regions of the garment where openings for passage of portions of a wearer are to be formed, including a neck portion as blinded.

* * * * *